US009368908B2

(12) United States Patent
Crooks

(10) Patent No.: US 9,368,908 B2
(45) Date of Patent: Jun. 14, 2016

(54) ELECTRICAL TERMINAL ASSEMBLY

(71) Applicant: Akron Brass Company, Wooster, OH (US)

(72) Inventor: Jared Crooks, Powell, OH (US)

(73) Assignee: AKRON BRASS COMPANY, Wooster, OH (US)

( * ) Notice: Subject to any disclaimer, the term of this patent is extended or adjusted under 35 U.S.C. 154(b) by 0 days.

(21) Appl. No.: 14/671,459

(22) Filed: Mar. 27, 2015

(65) Prior Publication Data

US 2015/0288095 A1 Oct. 8, 2015

Related U.S. Application Data

(60) Provisional application No. 61/974,550, filed on Apr. 3, 2014, provisional application No. 62/014,949, filed on Jun. 20, 2014.

(51) Int. Cl.

| | |
|---|---|
| ***H01R 13/533*** | (2006.01) |
| ***H01R 13/52*** | (2006.01) |
| ***H01R 43/00*** | (2006.01) |
| ***H01R 4/30*** | (2006.01) |

(52) U.S. Cl.

CPC ..... *H01R 13/533* (2013.01); *H01R 4/30* (2013.01); *H01R 13/521* (2013.01); *H01R 13/5205* (2013.01); *H01R 43/005* (2013.01); *Y10T 29/49208* (2015.01)

(58) Field of Classification Search

CPC ..... Y10T 29/49208; H01R 13/5205; H01R 13/521; H01R 43/005; H01R 4/30; H01R 13/533

USPC ..... 439/519; 29/876

See application file for complete search history.

(56) References Cited

U.S. PATENT DOCUMENTS

| | | | |
|---|---|---|---|
| 720,769 | A | 2/1903 | Woodworth |
| 847,768 | A | 3/1907 | Hartman |
| 1,099,292 | A | 6/1914 | Gibbs |
| 1,767,225 | A | 6/1930 | Oursler |
| 2,264,188 | A | 11/1941 | Paterno |

(Continued)

FOREIGN PATENT DOCUMENTS

| | | | |
|---|---|---|---|
| CA | 298379 | A | 3/1930 |
| CA | 1231564 | A1 | 1/1988 |

(Continued)

OTHER PUBLICATIONS

International Search Report, Patent Cooperation Treaty Application No. PCT/US2015/023670, Mailed Jul. 29, 2015.

*Primary Examiner* — Edwin A. Leon

(74) *Attorney, Agent, or Firm* — James R. Eley; Eley Law Firm Co, LPA

(57) ABSTRACT

An electrical terminal assembly includes at least one terminal, at least one terminal seal, and a terminal retainer. The terminal has a head and a shank, and the shank is configured to be received by a structure having an aperture. The terminal seal is configured to receive and engage the shank, and the shank is configured to engage the structure proximate the aperture. The terminal seal cooperates with the shank and the structure to resist ingress of contaminants into the aperture. The terminal retainer is configured to receive and selectably engage the head of the terminal and to electrically insulate the head. The terminal retainer is further configured to secure the terminal against rotation.

15 Claims, 10 Drawing Sheets

(56) References Cited

U.S. PATENT DOCUMENTS

| | | | | |
|---|---|---|---|---|
| 2,423,918 | A | 7/1947 | Wohlhieter | |
| 2,434,554 | A | 1/1948 | Fields | |
| 2,469,441 | A | 5/1949 | Pitisci | |
| 3,490,508 | A | 1/1970 | Nelson | |
| 4,346,734 | A | 8/1982 | Frank | |
| 4,684,190 | A | 8/1987 | Clark et al. | |
| 4,737,057 | A | 4/1988 | Olsson | |
| 4,883,431 | A * | 11/1989 | Uken | H02G 15/043 174/138 F |
| 5,139,440 | A | 8/1992 | Volk et al. | |
| 5,273,845 | A | 12/1993 | McHenry et al. | |
| 5,429,465 | A | 7/1995 | Puskas | |
| 5,663,015 | A | 9/1997 | Hooke et al. | |
| 5,834,134 | A | 11/1998 | Hooke et al. | |
| 6,039,596 | A * | 3/2000 | Whiteman, Jr. | H01R 13/5205 439/404 |
| 6,083,035 | A * | 7/2000 | Mackey | H01R 4/2408 439/410 |
| 6,183,905 | B1 | 2/2001 | Ling | |
| 6,390,848 | B1 | 5/2002 | Murakami et al. | |
| 6,409,224 | B1 | 6/2002 | Schmidt et al. | |
| 6,610,444 | B2 | 8/2003 | Akita et al. | |
| 6,899,570 | B2 | 5/2005 | Afanasiev et al. | |
| 2001/0016154 | A1 | 8/2001 | Laakkonen et al. | |
| 2002/0110437 | A1 | 8/2002 | Kirimoto | |
| 2003/0017391 | A1 | 1/2003 | Peterson et al. | |
| 2004/0181924 | A1 | 9/2004 | Saunders, II et al. | |
| 2005/0020367 | A1 | 1/2005 | Dao et al. | |
| 2011/0129318 | A1 | 6/2011 | Davies | |
| 2012/0251875 | A1 | 10/2012 | Yeh | |

FOREIGN PATENT DOCUMENTS

| | | | |
|---|---|---|---|
| CA | 2734659 | A1 | 9/2012 |
| EP | 1184916 | A2 | 3/2002 |
| GB | 815664 | A | 7/1959 |
| GB | 820287 | A | 9/1959 |
| GB | 2229241 | A | 9/1990 |
| GB | 2283551 | A | 5/1995 |
| GB | 2406365 | A1 | 3/2005 |
| TW | 555164 | | 9/2003 |

* cited by examiner

ELECTRICAL TERMINAL ASSEMBLY

CROSS-REFERENCE TO RELATED APPLICATIONS

This application claims priority to U.S. provisional application 61/974,550, filed Apr. 3, 2014, and U.S. provisional application 62/014,949, filed Jun. 20, 2014, the entire contents of each application being incorporated by reference herein.

FIELD

The present invention relates generally to electrical terminals, in particular to an electrical terminal assembly having environmental sealing, retention and electrically insulative features.

BACKGROUND

A wide variety of devices utilize electrical terminals to provide an interface point for electrical power and signals provided to (or from) the devices. When such devices are installed or operated in adverse environmental conditions it is desirable to seal the electrical terminals in some manner to deter the ingress of moisture and contaminants into the interior portions of the devices.

Electrical terminals are also frequently utilized in devices having compact construction and/or a housing enclosure with complex packaging requirements. In such situations electrically conductive portions of the terminals are often at risk of contacting a housing or enclosure of the device. When the housing or enclosure is electrically conductive this can result in an electrical short-circuit or other failure condition. Accordingly, relatively complex and labor-intensive electrical insulation arrangements are often required.

Further, electrical terminals may be utilized in environments and in applications where maintaining a stable and stationary positioning of the terminals is desired. Retention of the terminals in a manner that prevents rotation relative to the device housing allows for quick and easy attachment of threaded environmental seals. In addition, retention and stationary positioning of the terminals relative to the housing provides a more secure contact with the corresponding electrical connectors for the terminals to maintain electrical communication with the connectors. In such applications it is desirable to secure the terminals in place relative to an adjacent housing or enclosure to prevent rotation along their longitudinal axes and to prevent other undesirable repositioning, while also allowing for their quick and easy removal and replacement. Accordingly, there is a need for a way to efficiently and cost-effectively provide environmental sealing, secure retention and electrically insulative features for electrical terminals.

SUMMARY

An electrical terminal assembly is disclosed according to an embodiment of the present invention. The electrical terminal assembly includes one or more terminals, terminal seals and terminal retainers. The terminal seals deter the ingress of moisture and contaminants into a housing or enclosure to which the terminals are mounted. The terminal retainers securely engage the terminal heads and act to deter rotation and repositioning of the terminals while providing electrical insulation of the terminals from the housing.

In one embodiment the disclosed invention includes an electrical terminal assembly including a terminal and a terminal seal. The terminal has a head and a shank, and the shank is configured to be received by a structure having an aperture. The terminal seal is configured to receive and engage the shank, and further configured to engage the structure proximate the aperture. The terminal seal cooperates with the shank and the structure to resist ingress of contaminants into the aperture.

In one embodiment the disclosed invention includes an electrical terminal assembly including a terminal retainer. The terminal retainer is configured to receive and selectably engage a head of a terminal. The terminal retainer is further configured to electrically insulate the head of the terminal and to deter rotation of the terminal without the need for additional tools.

In another embodiment the disclosed invention includes an electrical terminal assembly including at least one terminal, at least one terminal seal, and a terminal retainer. The terminal has a head and a shank, and the shank is configured to be received by a structure having an aperture. The resilient terminal seal is configured to receive and snuggly engage the shank, and the shank is configured to engage the structure proximate the aperture. The terminal seal cooperates with the shank and the structure to resist ingress of contaminants into the aperture. The terminal retainer is configured to receive and captively engage the head of the terminal and to electrically insulate the head from the housing. The terminal retainer is further configured to secure the terminal against rotation.

In a further embodiment the disclosed invention includes a method for assembling an electrical terminal assembly. The method includes the step of obtaining at least one terminal, at least one terminal seal and a terminal retainer. The terminal has a head and a shank, and the shank is configured to be received by an aperture of a structure. The method includes inserting the shank through the aperture of the structure and into the at least one terminal seal. The terminal seal is configured to receive and snuggly engage the shank. The method includes positioning the at least one terminal seal to engage the shank and the structure proximate the aperture. The method includes the terminal seal cooperating with the shank and the structure to resist ingress of contaminants into the aperture. The terminal retainer is configured to receive and engage the head of the terminal and to electrically insulate the head from the housing. The method includes inserting the head of the terminal into the terminal retainer, and the terminal retainer electrically insulating the head from the housing and preventing rotation of the terminal during use without the need of additional tools.

BRIEF DESCRIPTION OF THE DRAWINGS

Further features of the inventive embodiments will become apparent to those skilled in the art to which the embodiments relate from reading the specification and claims with reference to the accompanying drawings, in which:

DETAILED DESCRIPTION

Figure 1:
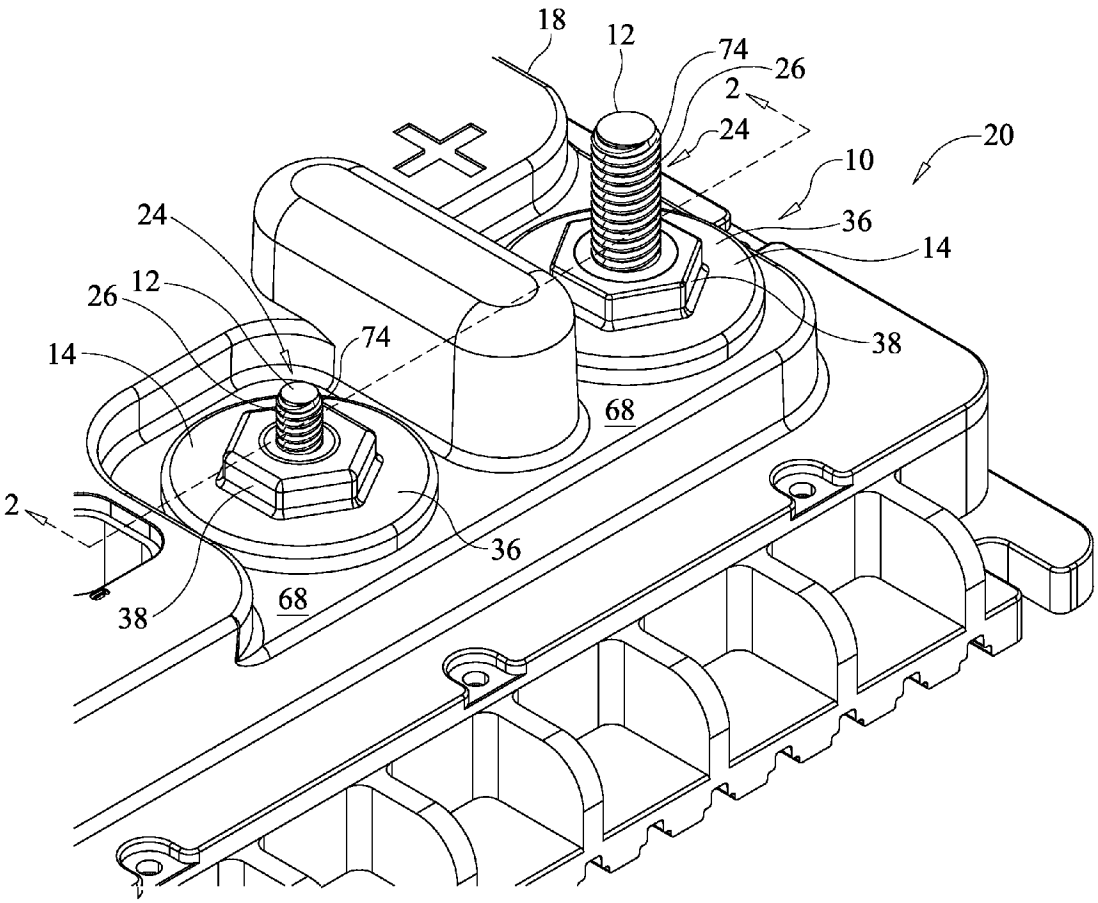
FIG. 1 is a perspective view of an external portion of an electrical terminal assembly according to an embodiment of the present invention.

In the discussion that follows, like reference numerals are used to refer to like structures and elements in the various figures.

Figure 2:
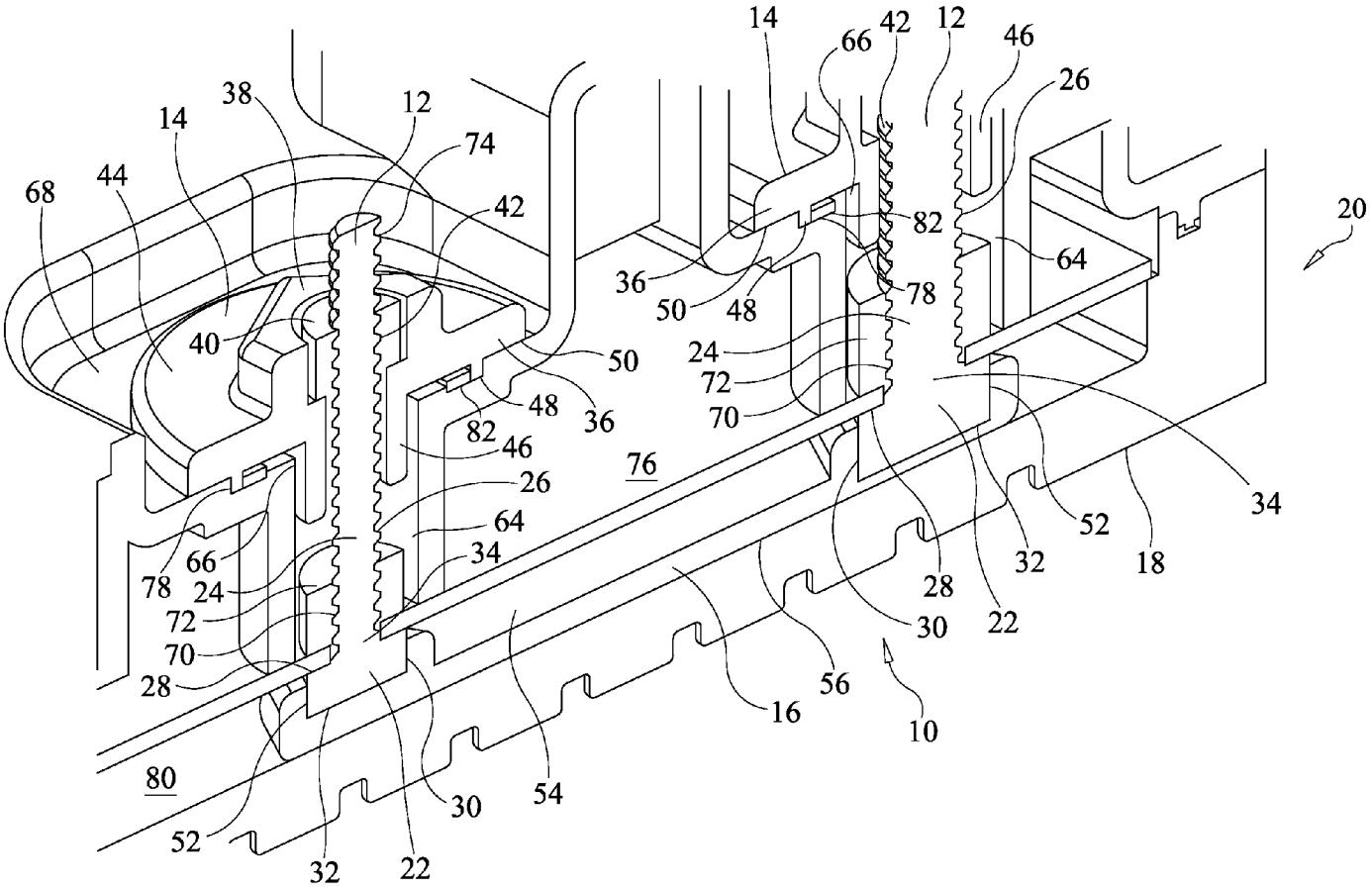
FIG. 2 is a view in section of the electrical terminal assembly of FIG. 1.

The general arrangement of an electrical terminal assembly 10 is shown in FIGS. 1 and 2 according to an embodiment of the present invention. Electrical terminal assembly 10 includes one or more terminals 12, terminal seals 14 and terminal retainers 16. Typically, electrical terminal assembly 10 is assembled to an enclosure or a housing 18 of a device 20.

Figure 13:
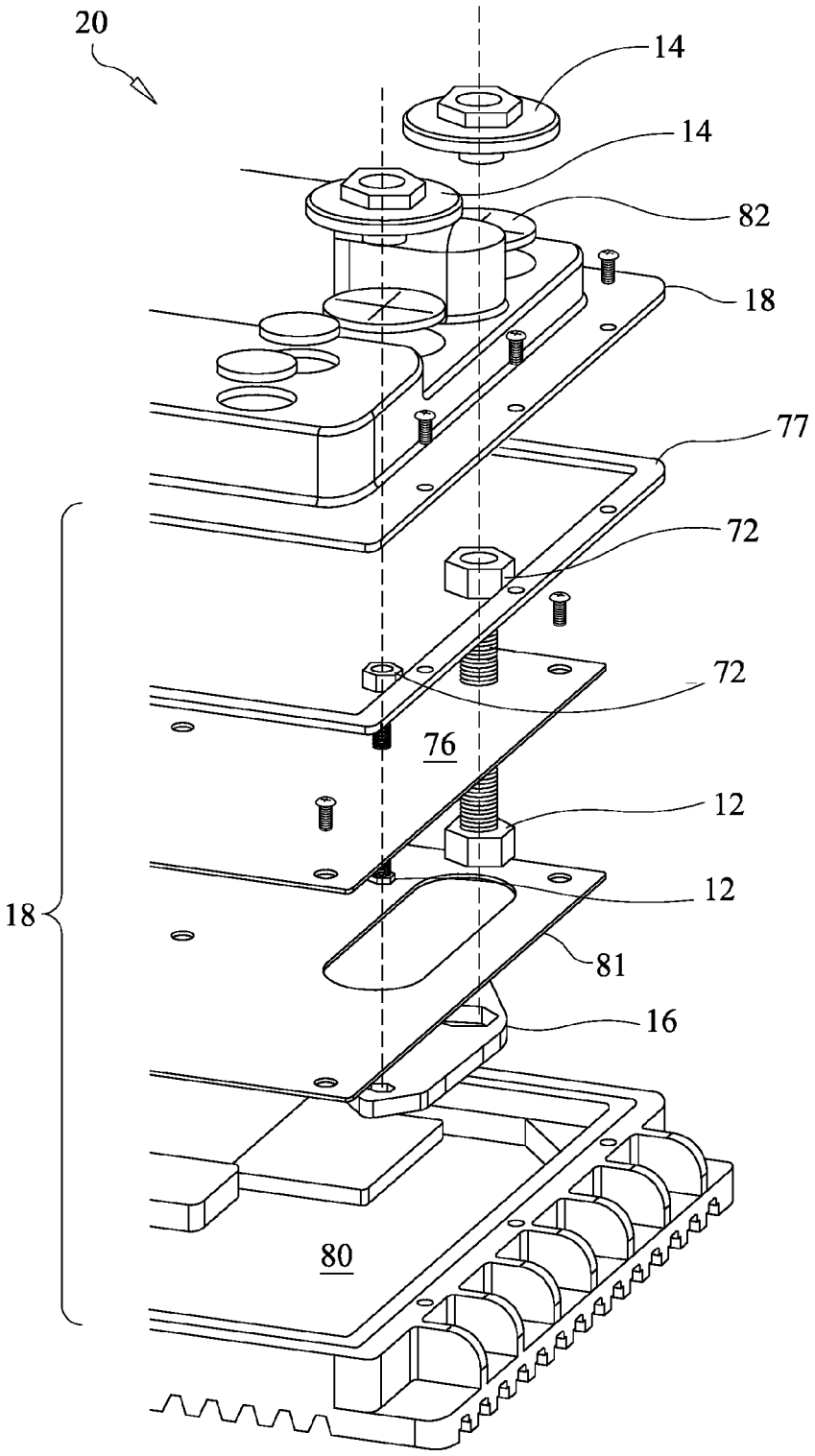
FIG. 13 is an exploded view of an electrical terminal assembly according to an embodiment of the present invention.

Terminals 12 may be any type of electrical connector that is suitable for a particular device 20. Terminal 12 is normally electrically conductive for electrical communication with an interior portion of device 20. In the embodiment of FIGS. 1, 2 and 13 terminals 12 are bolts having a terminal head portion 22 and a shank portion 24 with external threads 26. Terminal head portion 22 includes a shoulder surface 28, side surface 30 and end surface 32. Shoulder surface 28 extends from a base portion 34 of the shank portion 24 to the side surface 30. The side surface 30 of terminal head portion 22 may be any suitable shape such as, without limitation, hexagonal, square or star-shaped. In addition, terminals 12 may be made from any suitable electrically conductive materials and may be at least partially plated or coated, if desired. When a plurality of terminals 12 are utilized for a particular device they may or may not be configured to be the same size and shape.

Figure 3A:
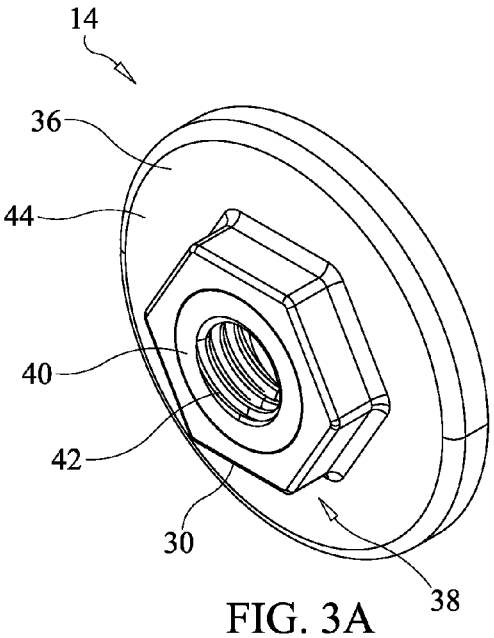
FIGS. 3A and 3B are perspective views of the front and rear, respectively, of a terminal seal according to an embodiment of the present invention.
Figure 3B:
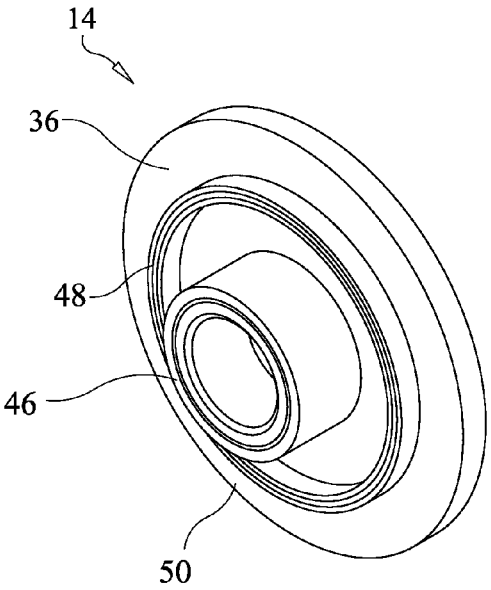
Figure 4:
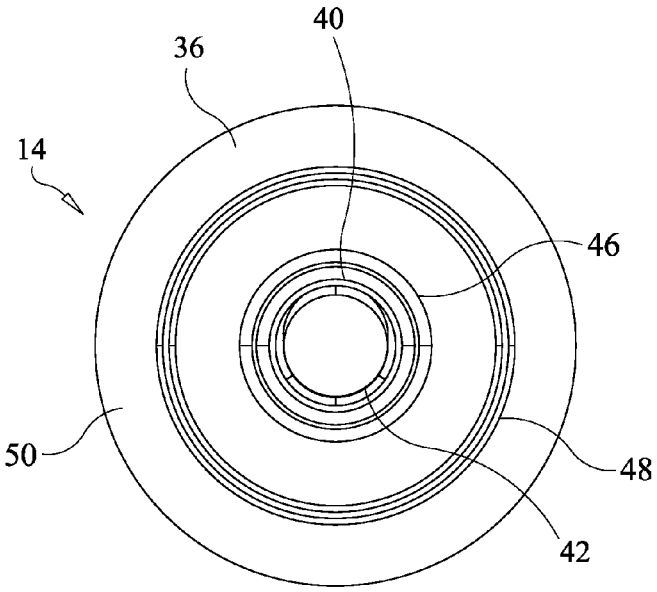
FIG. 4 is a plan view of a rear portion of the terminal seal of FIG. 3.

With reference to FIGS. 3A, 3B and 4, terminal seals 14 include a flange portion 36, a seal head portion 38 and an internally threaded portion 40. Internally threaded portion 40 includes internal threads 42 that are sized and shaped to receive external threads 26 of terminals 12. Seal head portion 38 extends away from a front surface 44 of terminal seal 14 and provides a finger or tool gripping surface for rotation of the terminal seal about a central longitudinal axis of the terminal 12. Seal head portion 38 may be any suitable shape such as, without limitation, hexagonal, square or star-shaped. Terminal seals 14 may further include a generally hollow sleeve 46 and a lip 48, each extending away from a rear surface 50 (see also FIG. 2). Sleeve 46 is configured to receive shank portion 24 of terminal 12 within. Lip 48 is configured to selectably engage and seal against the housing 18 to prevent contaminants from entering the interior of device 20.

Terminal seals 14 may be made from separate components and assembled together. As a non-limiting example, internally threaded portion 40 may be formed as a separate nut or threaded insert made of metal or other suitable durable material that can be molded together within seal head portion 38 using plastic or some other suitable corrosion-resistant material to form the terminal seal 14. Alternatively, terminal seals 14 may be fabricated as a single or unitary piece from a suitable electrically insulative material, such as a plastic or composite. Terminal seals 14 may further be made from assembled metal pieces or from a unitary metal piece, and optionally finished with either a conductive or non-conductive material. Terminal seals 14 may be provided in one or more predetermined colors, such as red to indicate positive electrical polarity and black to indicate negative electrical polarity in the case of direct current (DC) electrical power terminals.

Figure 5:
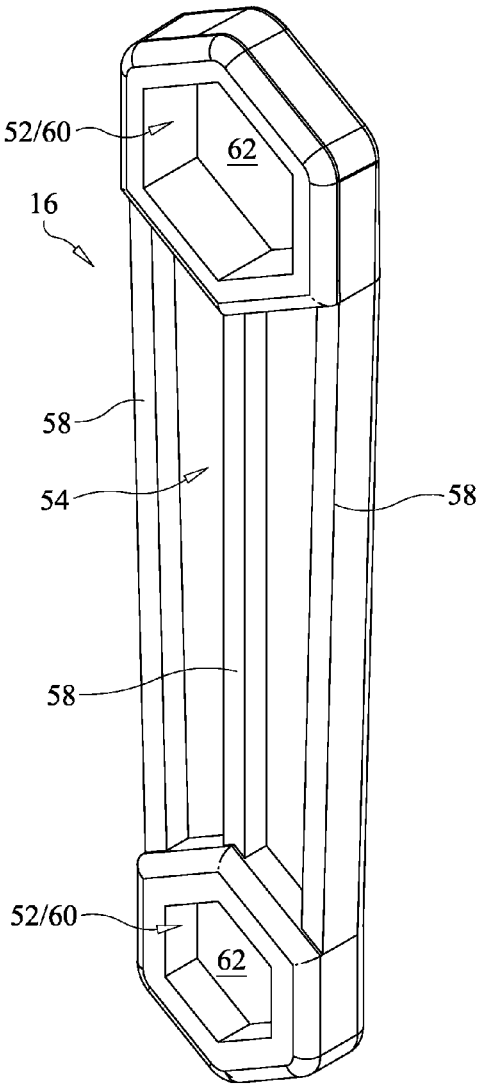
FIG. 5 is a perspective view of a front portion of a terminal retainer according to an embodiment of the present invention.
Figure 6:
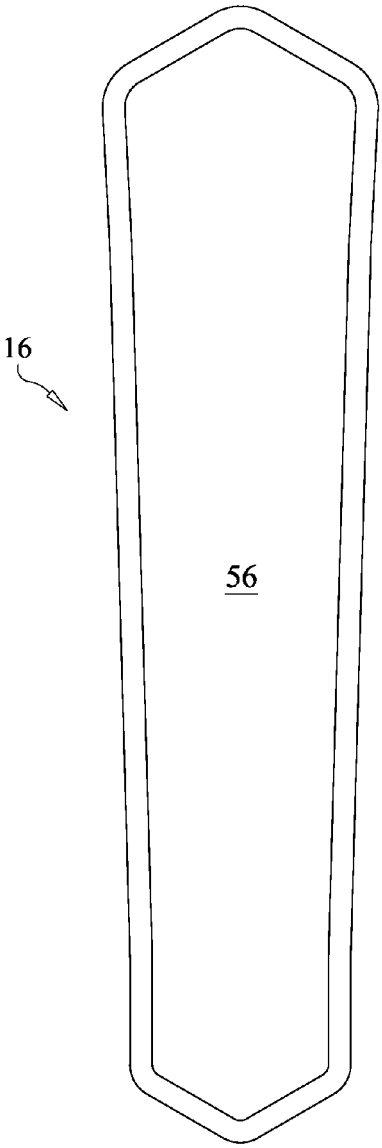
FIG. 6 is a plan view of a rear portion of the terminal retainer of FIG. 5.
Figure 7:
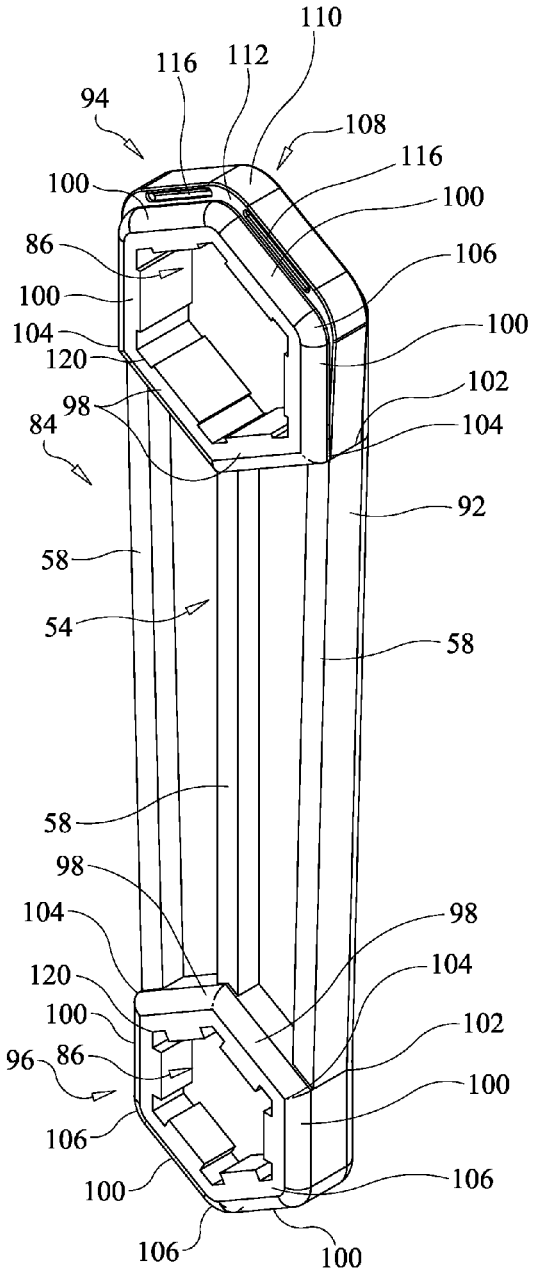
FIG. 7 is a perspective view of a front portion of a terminal retainer according to another embodiment of the present invention.
Figure 8:
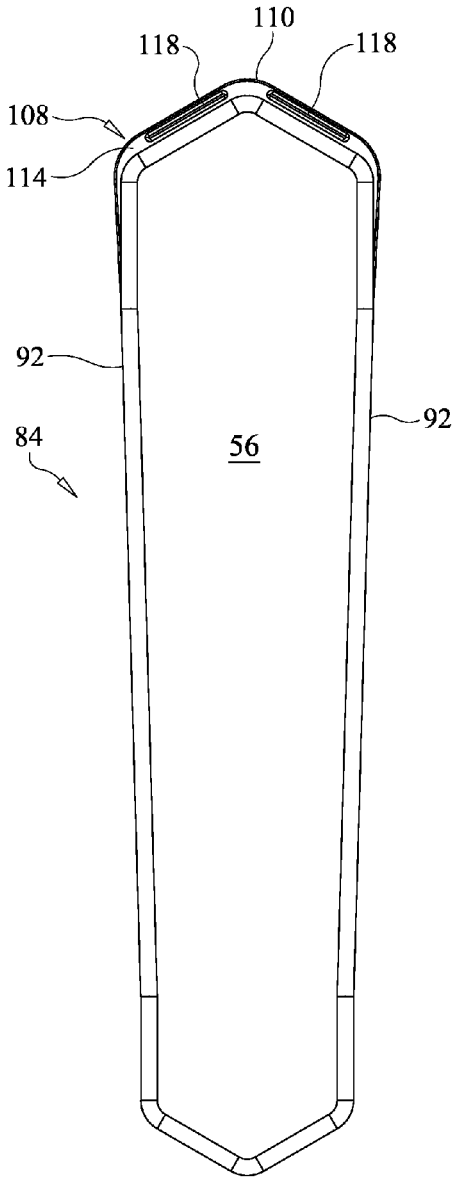
FIG. 8 is a plan view of a rear portion of the terminal retainer of FIG. 7.
Figure 9:
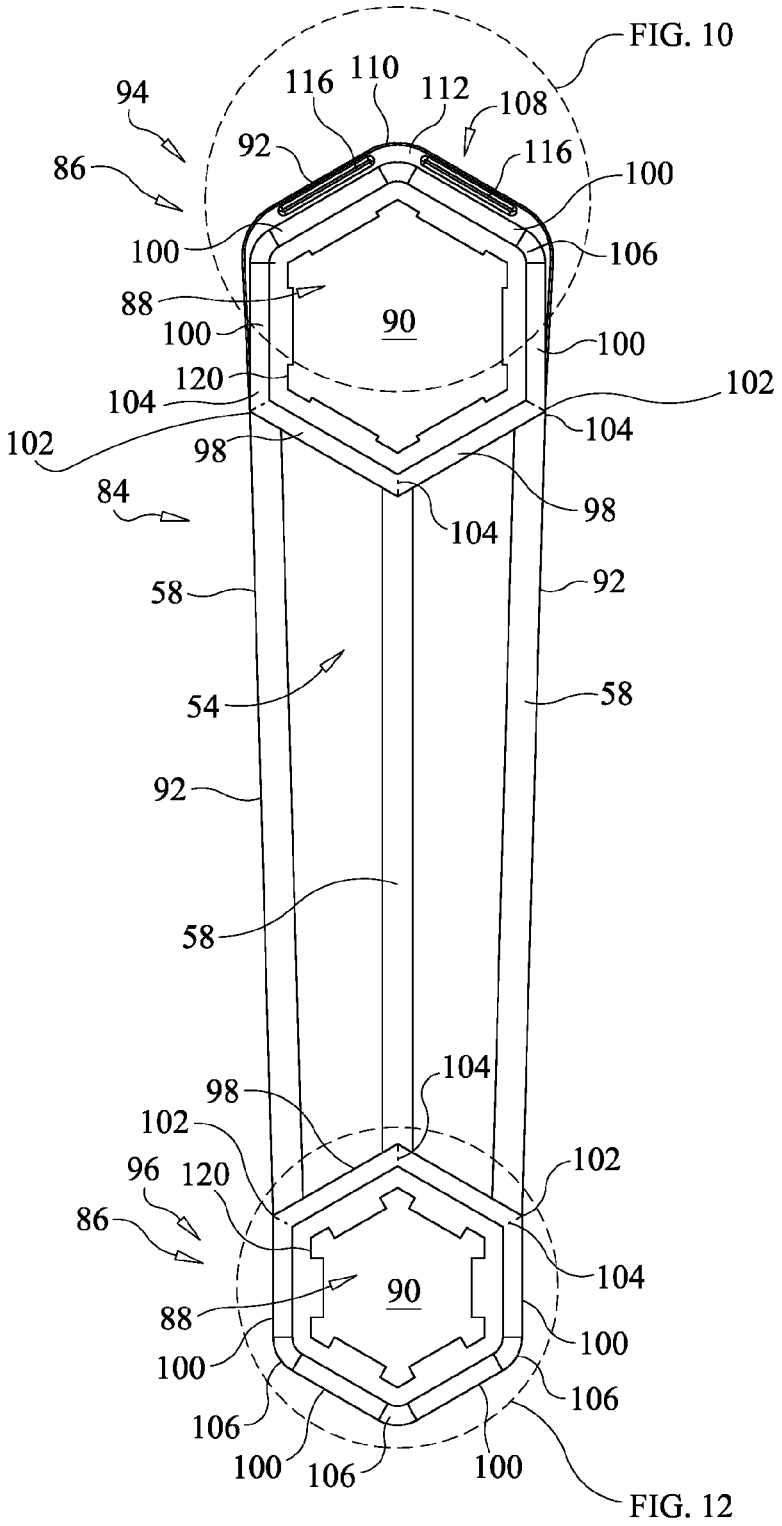
FIG. 9 is a plan view of a front portion of the terminal retainer of FIG. 7.
Figure 10:
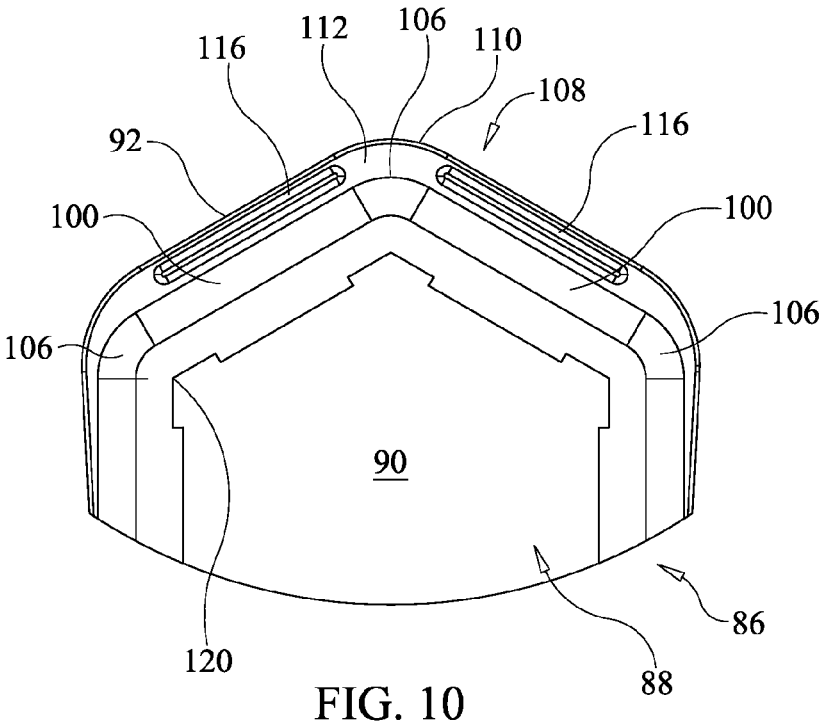
FIG. 10 is an enlarged view of a front portion of a reinforcing ridge of the terminal retainer of FIG. 9.

With reference now to FIGS. 5 and 6, terminal retainer 16 includes one or more formed receptacles 52 extending away from a front side 54 and preferably closed off by an opposing rear side 56. In one embodiment front side 54 of terminal retainer 16 is generally hollow and may further include one or more ribs 58 extending between spaced-apart receptacles 52 to add strength and rigidity. Alternatively, front side 54 may be formed without ribs or recesses between ribs as a solid planar member of generally uniform thickness between the receptacles. Each of the receptacles 52 includes a recess 60 configured to receive and engage terminal head portions 22. Recess 60 is preferably sized and shaped for a slight interference fit with corresponding terminal head portions 22. Each recess 60 may be configured in a different size and shape to match each corresponding terminal head portions 22, and may be any suitable shape such as, without limitation, hexagonal, square or star-shaped. Recess 60 is configured with sufficient depth to receive at least a portion of the corresponding side surface 30 of terminal head portion 22. In one embodiment recess 60 is configured to receive at least a majority of the corresponding side surface 30 of terminal head portion 22. Recess 60 preferably includes a solid or continuous end wall 62 configured to cover the end surface 32 of corresponding terminal head portion 22. Terminal retainers 16 are thus configured to electrically insulate the terminal head portion 22 from the adjacent housing 18.

With reference again to FIGS. 1, 2 and 13, terminal 12 is configured for electrical communication from the interior portion to the exterior portion of housing 18. Housing 18 includes one or more bores 64 extending from the interior of device 20 to apertures 66 in an exterior surface 68 of the housing. Bores 64 are configured to receive shank portion 24 of terminals 12 and to receive sleeve 46 of terminal seal 14 proximate aperture 66. Optionally, bores 64 may include internal threads 70 that are sized and shaped to receive external threads 26 of terminals 12. Optionally, device 20 may include separate nuts 72 having internal threads 70, whereby apertures 66 may each be configured to receive a corresponding nut during assembly of the device.

The shank portion 24 of terminals 12 include a tip 74 configured for electrical communication with a corresponding connector (not shown) exterior to the device 20. In one embodiment, an electrical conductor such as printed wiring board 76 (FIG. 13) is disposed proximate to bores 64 and configured to be in electrical communication with terminals 12. The electrical conductor may be any suitable conductor disposed in the interior of device 20. In other embodiments, an additional electrical conductor (not shown) in communication with printed wiring board 76 is disposed adjacent to each bore 64 and is configured to be in electrical communication with either or both of terminals 12.

Electrical terminal assembly 10 may be assembled to housing 18 by inserting tips 74 of terminals 12 through printed wiring board 76, nuts 72 and bores 64 of the housing. In one embodiment, device 20 further includes a gasket 77 to seal perimeter openings of housing 18 (see FIG. 13). The external threads 26 of terminals 12 may be threaded onto internal threads 70 of nuts 72. Terminal 12 may be inserted through bore 64 such that tips 74 may extend through apertures 66 and above exterior surface 68 of housing 18. A terminal retainer 16 is then urged against head portions 22 of terminals 12 such that receptacles 52 receive and engage a corresponding head portion. In this manner terminal retainer 16 is selectably coupled to terminals 12 and deters the terminals from rotating about their central longitudinal axes to facilitate torque during installation of the terminal seals 14.

A terminal seal 14 is then threaded onto the shank portion 24 of each terminal 12. Tips 74 of the shank portions 24 are inserted through the sleeve 46 of a corresponding terminal seal 14 such that external threads 26 of the terminals engage the internal threads 42 of the terminal seals. Terminal seals 14 are threaded onto the corresponding terminals 12 until the terminal seals are secured against surface 68 of housing 18. As terminal seals 14 are threaded onto terminals 12, lips 48 of the terminal seals sealingly engage corresponding grooves 78 formed in surface 68 and sleeves 46 are received within apertures 66 of bores 64 (see FIG. 2).

Terminal seals 14 are preferably threaded onto the corresponding terminals 12 to a point where the shoulder surfaces 28 of terminal head portions 22 are adjacent to or engage mechanically and/or electrically with corresponding printed wiring board 76. Once terminal seals 14 are thus installed, tips 74 remain exposed on the exterior of device 20, ready for coupling and electrical communication with corresponding connectors (not shown) exterior to the device 20. After terminal seals 14 are installed, the rear side 56 of the terminal retainer 16 may be positioned adjacent or against an internal surface of housing 18, such as heat sink 80, for example (see FIG. 2). In one embodiment device 20 further includes a thermal pad 81 intermediate printed wiring board 76 and heat sink 80 (see FIG. 13). Once the assembly of housing 18 is completed, the terminal retainer 16 remains intermediate the terminal 12 and the heat sink 80, thus providing electrical insulation therebetween.

Optionally, a sealing gasket 82 may be placed intermediate to surface 68 and the rear surface 50 of each of terminal seals 14 to provide an environmental seal for the terminal assembly 10. Gasket 82 may be made from any suitable compressible materials such as, without limitation, plastic and elastomerics such as natural and synthetic rubber. Gasket 82 may be made as a formed piece and attached to rear surface 50 of terminal seal 14, to surface 68, or both. Alternatively, gasket 82 may be left unattached and be captively retained between surface 68 and rear surface 50. In an alternative embodiment gasket 82 may be a generally solid disk having cross-slits (FIG. 13). In still another alternative embodiment gasket 82 may be in the shape of an O-ring. In yet another alternative embodiment gasket 82 may be applied as a liquid, gel or foam to creates a form-in-place seal. Optionally, thread-sealing and/or thread-locking materials may be applied between external threads 26 and either or both of internal threads 42, 70 to deter terminal 12 from rotating during use.

In the assembled state terminal retainer 16 secures terminals 12 against rotational movement during attachment of the corresponding external connectors (not shown) to tips 74. In addition, terminal retainer 16 maintains position of terminals 12 (and thus the terminal seals 14) to deter loosening or repositioning of the terminals during use of the device, especially in applications subject to vibration. Furthermore, in the assembled state terminal assembly 10 provides an electrical termination point that resists the ingress of contaminants into housing 18.

With reference now to FIGS. 7-12, in an alternative embodiment a terminal retainer 84 includes one or more receptacles 86 extending away from a front side 54 and preferably (although not necessarily) closed off by an opposing rear side 56. In one embodiment front side 54 of terminal retainer 84 is generally hollow and may further include one or more ribs 58 extending between spaced-apart receptacles 86 to add strength and rigidity. Alternatively, front side 54 may be formed without ribs or recesses between ribs as a solid planar member of generally uniform thickness between the receptacles. Each of the receptacles 86 includes a recess 88 configured to receive and engage a corresponding terminal head portion 22 (see FIG. 12). Recess 88 is preferably sized and shaped for a slight interference fit with corresponding terminal head portions 22, and may be any suitable shape such as, without limitation, hexagonal, square or star-shaped. Recess 88 is configured with sufficient depth to receive at least a majority of the corresponding side surface 30 of terminal head portion 22. Recess 88 preferably includes a solid end wall 90 configured to cover the entirety of end surface 32 of corresponding terminal head portion 22. Terminal retainers 16 are thus configured to electrically insulate the terminal head portion 22 from the adjacent housing 18.

Referring again to FIGS. 7-12, terminal retainers 84 include a peripheral side 92 joining front side 54 and rear side 56. Terminal retainers 84 may include a first cavity 94 and a second, spaced-apart cavity 96, the cavities of which may each be configured of different shapes and sizes to correspond with the shapes and sizes of terminal head portions 22. Receptacles 86 each include a first portion 98 and a second portion 100, joined at joints 102. The first portions 98 of each receptacle 86 are oriented facing toward each other and the second portions 100 of each receptacle 86 are disposed along peripheral side 92. First portions 98 include one or more first corners 104 and second portions 100 include one or more second corners 106. A portion of peripheral side 92 is disposed on the second portions 100.

A reinforcing ridge 108 may be formed on peripheral side 92 proximate to either of first and second cavities 94, 96 to provide structural reinforcement. Reinforcing ridge 108 may be formed as an extension of peripheral side 92 along the second portion 100. Reinforcing ridge 108 may be formed with a varying thickness that tapers out from a minimum at first corners 104 of receptacles 86 to a maximum at a peak 110 proximate second corners 106 of the receptacles. Reinforcing ridge 108 may be made integral with peripheral side 92 or may be made separately and attached thereto. Reinforcing ridge 108 may include a front side 112 and an opposing rear side 114. Front side 112 and/or rear side 114 may include one or more front channels 116 and/or rear channels 118, respectively, formed therein. Front channels 116 and rear channels 118 may be formed as recesses, or alternatively, may be formed as protrusions.

Figure 12:
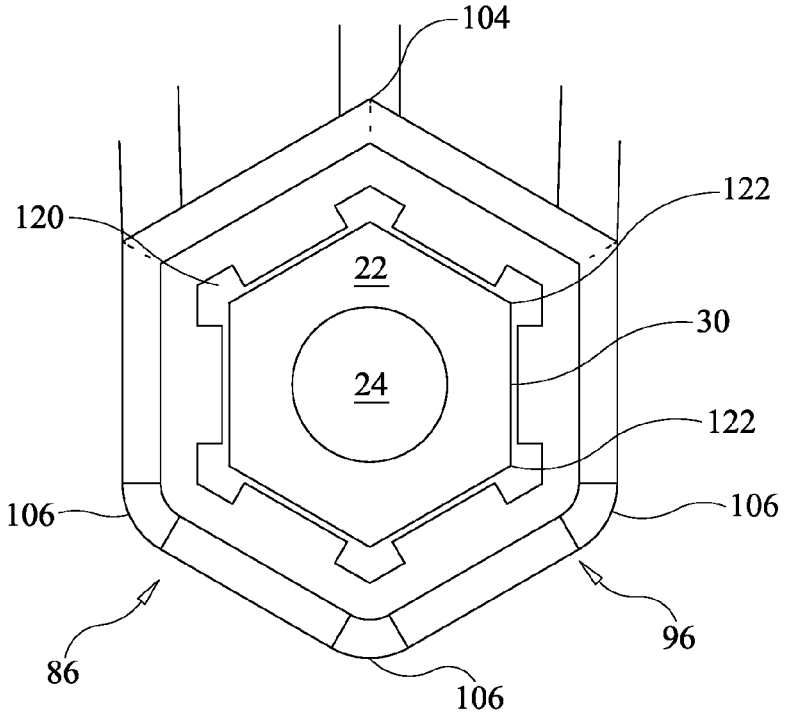
FIG. 12 is an enlarged view of a front portion of a receptacle of the terminal retainer of FIG. 9, showing a terminal head portion assembled within.
Figure 11:
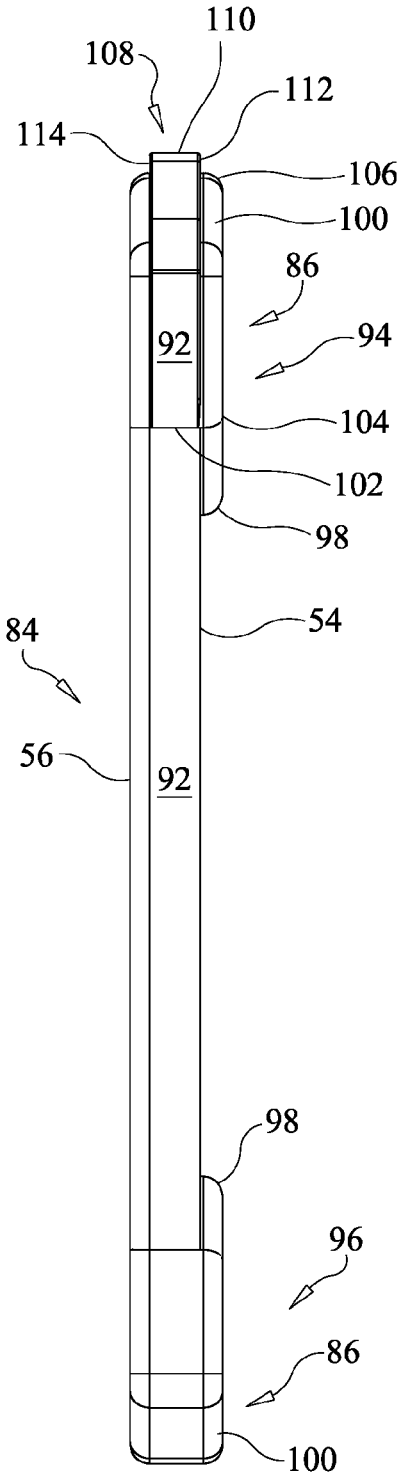
FIG. 11 is a side view of the terminal retainer of FIG. 7.

Recesses 84 may further include one or more notches 120 which may be disposed at one or more of the first corners 104 and the second corners 106 for a snug fit. Notches 120 are configured to allow selectable physical expansion of receptacles 86 during insertion onto terminal head portions 22. Referring to FIG. 12, preferably, side surface 30 of terminal head portion 22 includes one or more corners 122. Notches 120 are additionally configured to retain corners 122 to prevent terminals 12 from rotating about their central longitudinal axes. Terminal retainer 84 may be installed and used in device 20 similarly to terminal retainer 16 to secure and insulate terminals 12 relative to housing 18.

Figure 14:
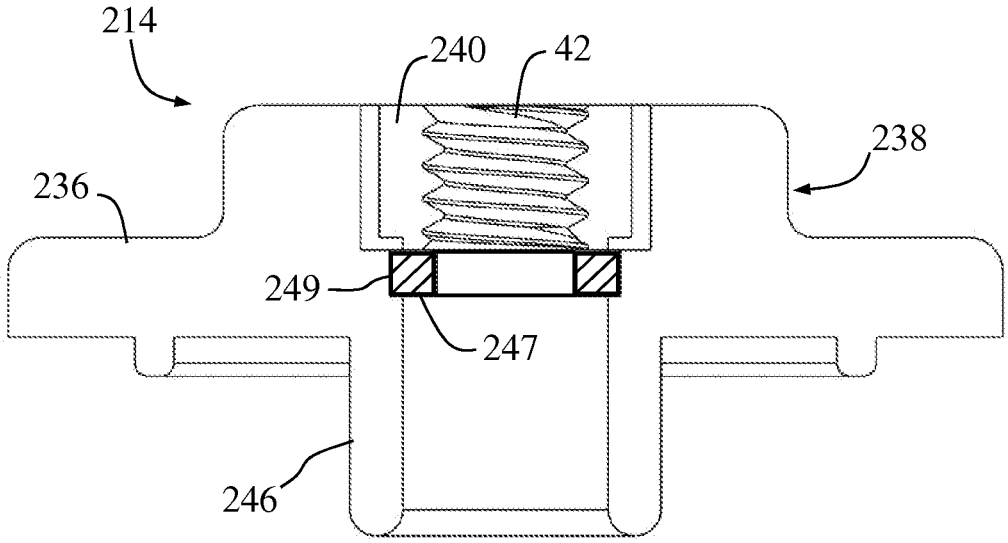
FIG. 14 is a view in section of a side of a terminal seal according to another embodiment of the present invention.

With reference now to FIG. 14, in an alternative embodiment a terminal seal 214 includes a flange portion 236, a seal head portion 238 and an internally threaded portion 240. Internally threaded portion 240 includes internal threads 42 that are sized and shaped to receive external threads 26 of terminals 12. Terminal seal 214 may further include a generally hollow sleeve 246 similar to sleeve 46, and configured to receive shank portion 24 of terminal 12 within. Terminal seal 214 functions generally similar to terminal seal 14, but further includes a sealing gasket 247 configured to snuggly engage terminal shank portion 24 to substantially prevent fluid and other contaminants from wicking down the internal threads 42. At least a portion of gasket 247 may be configured to be received in a recess 249 of sleeve 246. Also, gasket 247 may be configured to abutt against a portion of internally threaded portion 240 adjacent to sleeve 246 to provide an environmental seal for the terminal assembly 10.

Gasket 247 may be made from any suitable compressible materials such as, without limitation, plastic and elastomerics such as natural and synthetic rubber or polyethylene terephthalate (PET). Gasket 247 may be made as a formed piece and attached to internally threaded portion 240 and/or sleeve 246 and/or recess 249. Alternatively, gasket 82 may be left unattached and held captively between an interior facing portion of sleeve 246 and the external threads 26 of terminal 12. Although shown as a disk-shaped gasket, gasket 247 may be in the shape of an O-ring. In an alternative embodiment gasket 247 may be a generally solid disk having cross-slits. In yet another alternative embodiment gasket 247 may be applied in a liquid, gel or foam form as a form-in-place seal, co-molded in place.

Terminal retainers 16, 84 may be made from any suitable material, such as plastic or composites. Preferably, terminal retainers 16, 84 are made from an electrically non-conductive material, although electrically conductive substrates that are coated or plated with a suitable insulative layer may be used within the scope of the invention. Alternatively, recesses 60, 88 may include metal or other durable material that is molded together with plastic or some other suitable non-conductive material to form terminal retainers 16, 84.

Although two terminals 12 are shown and described herein, a greater or lesser number of terminals are possible within the scope of the invention. Although two receptacles 52, 86 for each terminal retainer 16, 84, respectively, are shown and described herein, a greater or lesser number of receptacles are possible within the scope of the invention. In addition, terminal retainers 16, 84 may optionally be selectably or permanently coupled to an adjacent structure to deter rotational movement of a corresponding terminal 12, for example if a single terminal is provided. Optionally, a material including adhesive or tacky properties may be further used to assist in joining the terminal retainer 16, 84 to the terminal head portions 22. Optionally, some or all of the features of the alternative embodiment terminal retainer 84 of FIGS. 7-12, such as notches 120 or reinforcing ridge 108, may likewise be provided in the embodiment of terminal retainer 16 of FIGS. 5 and 6.

While the foregoing description relates to the use of the electrical terminal assembly in connection with a housing structure of a device, one skilled in the art will readily recognize that the electrical terminal assembly may be used to advantage in connection with any suitable structure. For example, the electrical terminal assembly may be assembled to a panel structure.

While this invention has been shown and described with respect to a detailed embodiment thereof, it will be understood by those skilled in the art that changes in form and detail thereof may be made without departing from the scope of the claims of the invention.

What is claimed is:

1. An electrical terminal assembly, comprising:

a terminal having a head and a shank, the shank being configured to be received by a structure having an aperture; and a terminal seal configured to receive and engage the shank, the terminal seal being further configured to engage the structure proximate the aperture, the terminal seal cooperating with the shank and the structure to resist ingress of contaminants into the aperture;

the terminal seal further including, a flange portion, a seal head portion, and an internally threaded portion;

the shank of the terminal further including external threads;

the internally threaded portion of the terminal seal being configured to threadably engage the external threads of the shank of the terminal.

2. The electrical terminal assembly of claim 1 wherein the at least one terminal comprises two or more terminals.

3. The electrical terminal assembly of claim 1 wherein the terminal seal further includes:

the flange portion and the seal head portion being formed of an electrically insulative material; and the internally threaded portion being made from a metal material, the internally threaded portion being disposed within the seal head portion.

4. An electrical terminal assembly, comprising:

a terminal having a head and a shank, the shank being configured to be received by a structure having an aperture; and a terminal seal configured to receive and engage the shank, the terminal seal being further configured to engage the structure proximate the aperture, the terminal seal cooperating with the shank and the structure to resist ingress of contaminants into the aperture;

the terminal seal further including, a rear surface;

a generally hollow sleeve extending away from the rear surface, the sleeve being configured to be received by the aperture of the structure; and a lip extending away from the rear surface, the lip being configured to engage the structure.

5. The electrical terminal assembly of claim 4 wherein the shank of the terminal is configured to threadingly engage a bore of the structure, the bore being intermediate an interior portion of the structure and the aperture of the structure, the bore further being configured to receive the sleeve of the terminal seal.

6. The electrical terminal assembly of claim 4 wherein the electrical terminal assembly further includes a gasket, the gasket being intermediate an exterior surface of the structure and the rear surface of the terminal seal.

7. The electrical terminal assembly of claim 6 wherein the gasket is disposed intermediate the lip and the sleeve, the gasket further being configured to sealingly confront the lip.

8. An electrical terminal assembly, comprising:

a terminal retainer, the terminal retainer being configured to receive and selectably engage a head of a terminal, the terminal retainer being further configured to electrically insulate the head of the terminal, the terminal retainer being further configured to deter rotation of the terminal;

the terminal retainer includes at least one receptacle configured to receive and selectably engage the head of the terminal;

the receptacle further including, a recess having at least one corner, and a notch formed in the corner;

the notch being configured to selectably retain a corresponding corner of the head of the terminal;

the recess including an end wall, the end wall being configured to electrically insulate the head of the terminal.

9. The electrical terminal assembly of claim 8 wherein:

the head of the terminal includes an end surface; and the end wall covers the end surface.

10. The electrical terminal assembly of claim 8 wherein the terminal retainer further includes:

a second receptacle spaced apart from the first receptacle.

11. The electrical terminal assembly of claim 10 wherein the first receptacle is configured of a different size from the second receptacle.

12. The electrical terminal assembly of claim 8 wherein the terminal retainer includes:

a generally hollow front side having at least one rib;

a rear side; and a peripheral side, the peripheral side extending between the front side and the rear side.

13. The electrical terminal assembly of claim 12 wherein the peripheral side further includes a reinforcing ridge.

14. The electrical terminal assembly of claim 13 wherein the reinforcing ridge further includes at least one channel.

15. An electrical terminal assembly, comprising:

at least one terminal having a head and a shank, the shank being configured to be received by a structure having an aperture;

at least one terminal seal configured to receive and engage the shank, the shank being configured to engage the structure proximate the aperture, the terminal seal cooperating with the shank and the structure to resist ingress of contaminants into the aperture; and a terminal retainer configured to receive and selectably engage the head of the terminal and to electrically insulate the head, the terminal retainer being further configured to secure the terminal against rotation;

the terminal seal further including, a flange portion, a seal head portion, and an internally threaded portion;

the shank of the terminal further including external threads;

the internally threaded portion of the terminal seal being configured to threadably engage the external threads of the shank of the terminal.

* * * * *